US009236653B2

(12) United States Patent
Liu et al.

(10) Patent No.: US 9,236,653 B2
(45) Date of Patent: Jan. 12, 2016

(54) ANTENNA DEVICE

(75) Inventors: Ruopeng Liu, Guangdong (CN); Guanxiong Xu, Guangdong (CN); Songtao Yang, Guangdong (CM); Yuefeng Li, Guangdong (CN)

(73) Assignees: KUANG-CHI INNOVATIVE TECHNOLOGY LTD., Futian District, Shenzhen, Guangdong (CN); KUANG-CHI INSTITUTE OF ADVANCED TECHNOLOGY, High-Tech Industrial Estate, Nanshan District, Shenzhen, Guangdong (CN)

( * ) Notice: Subject to any disclaimer, the term of this patent is extended or adjusted under 35 U.S.C. 154(b) by 546 days.

(21) Appl. No.: 13/522,022

(22) PCT Filed: Sep. 30, 2011

(86) PCT No.: PCT/CN2011/080496

§ 371 (c)(1), (2), (4) Date: Jul. 13, 2012

(87) PCT Pub. No.: WO2012/155438

PCT Pub. Date: Nov. 22, 2012

(65) Prior Publication Data

US 2012/0293385 A1 Nov. 22, 2012

(30) Foreign Application Priority Data

May 17, 2011 (CN) ..... 2011 1 0127677

(51) Int. Cl.

| | |
|---|---|
| ***H01Q 1/38*** | (2006.01) |
| ***H01Q 21/29*** | (2006.01) |
| ***H01Q 5/364*** | (2015.01) |
| ***H01Q 9/04*** | (2006.01) |
| ***H01Q 21/06*** | (2006.01) |

(52) U.S. Cl.
CPC ..... *H01Q 1/38* (2013.01); *H01Q 5/364* (2015.01); *H01Q 9/045* (2013.01); *H01Q 21/065* (2013.01); *H01Q 21/29* (2013.01)

(58) Field of Classification Search
CPC ..... H01Q 21/28
USPC ..... 343/725, 726, 727, 728
See application file for complete search history.

(56) References Cited

U.S. PATENT DOCUMENTS

| | | | | |
|---|---|---|---|---|
| 2006/0097916 | A1 * | 5/2006 | Bogosanovic | 343/700 MS |
| 2008/0036662 | A1 * | 2/2008 | Iwata et al. | 343/700 MS |

FOREIGN PATENT DOCUMENTS

| | | | | |
|---|---|---|---|---|
| CN | 101740862 | A | 6/2010 | |
| CN | 101740862 | A * | 6/2010 | H01Q 1/38 |

OTHER PUBLICATIONS

J. P. Daniel et al., Research on planar antennas and "Structures Rayonnantes", Feb. 1993, pp. 14-38, XP000303381, IEEE Antennas and Propagation Magazine, vol. 35, No. 1, New York, US.

*Primary Examiner* — Robert Karacsony
(74) *Attorney, Agent, or Firm* — Winston Hsu; Scott Margo

(57) ABSTRACT

The present disclosure discloses an antenna device, which comprises an array antenna and a power divider. The array antenna comprises a plurality of antenna units, and each of the antenna units comprises a conductive sheet engraved with a groove topology pattern, conductive feeding points and a feeder line. The power divider is adapted to divide a baseband signal into a plurality of weighted signals and then transmit the weighted signals to the antenna units arranged in an array via the conductive feeding points respectively. By arraying the antenna units and using the beam forming method, the directionality of the antenna can be designed as needed through phase superposition between the antenna units; and then, a reflective metal plate is provided on the back side of the antenna so that a back lobe of the antenna is compressed. In this way, the miniaturized antenna array can obtain a high directionality.

10 Claims, 4 Drawing Sheets

ANTENNA DEVICE

FIELD OF THE INVENTION

The present disclosure relates to an antenna device.

BACKGROUND OF THE INVENTION

With advancement of the semiconductor manufacturing processes, requirements on the integration level of modern electronic systems become increasingly higher, and correspondingly, miniaturization of components has become a problem of great concern in the whole industry. However, unlike integrated circuit (IC) chips that advance following the Moore's Law, radio frequency (RF) modules which are known as another kind of important components in the electronic systems are very difficult to be miniaturized. An RF module mainly includes a mixer, a power amplifier, a filter, an RF signal transmission component, a matching network and an antenna as key components thereof. The antenna acts as a transmitting unit and a receiving unit for RF signals, and the operation performances thereof have a direct influence on the operation performance of the overall electronic system. However, some important indicators of the antenna such as the size, the bandwidth and the gain are restricted by the basic physical principles (e.g., the gain limit under the limitation of a fixed size, and the bandwidth limit). The limits of these indicators make miniaturization of the antenna much more difficult than miniaturization of other components; and furthermore, due to complexity of analysis of the electromagnetic field of the RF component, even approximately reaching these limits represents a great technical challenge.

Meanwhile, as the modern electronic systems become more and more complex, the multi-mode services become increasingly important in wireless communication systems, wireless accessing systems, satellite communication systems, wireless data network systems and the like. The demands for multi-mode services further increase the complexity of the design of miniaturized multi-mode antennae. In addition to the technical challenge presented by miniaturization, multi-mode impedance matching of the antennae has also become a technical bottleneck for the antenna technologies. On the other hand, the rapid development of multiple input and multiple output (MIMO) systems in fields of wireless communications and wireless data services further heightens the requirement on miniaturization of antennae and, meanwhile, requires availability of a desirable isolation degree, desirable radiation performances and desirable interference immunity. However, the communication antennae of conventional terminals are designed primarily on the basis of the electric monopole or dipole radiating principles, an example of which is the most common planar inverted F antenna (PIFA). For a conventional antenna, the radiating operation frequency thereof is positively correlated with the size of the antenna directly, and the bandwidth is positively correlated with the area of the antenna, so the antenna usually has to be designed to have a physical length of a half wavelength. Besides, in some more complex electronic systems, the antenna needs to operate in a multi-mode condition, and this requires use of an additional impedance matching network design at the upstream of the infeed antenna. However, the additional impedance matching network adds to the complexity in design of the feeder line of the electronic systems and increases the area of the RF system and, meanwhile, the impedance matching network also leads to a considerable energy loss. This makes it difficult to satisfy the requirement of a low power consumption in the design of the electronic systems. Especially, for indoor directional antenna designs, the antenna gain cannot well satisfy the user's needs, and the directionality is not so good.

SUMMARY OF THE INVENTION

In view of the aforesaid shortcomings of the prior art, an objective of the present disclosure is to provide a miniaturized antenna device which is capable of transmitting or receiving electromagnetic waves in a directional way.

To achieve the aforesaid objective, the present disclosure provides an antenna device, which includes an array antenna, a power divider, a reflecting unit and a medium substrate. The array antenna includes a plurality of antenna units, and each of the antenna units includes a conductive sheet engraved with a groove topology pattern, conductive feeding points and a feeder line. The power divider is adapted to divide a baseband signal into a plurality of weighted signals and then transmit the weighted signals to the antenna units arranged in an array via the conductive feeding points respectively. The reflecting unit is adapted to reflect a backward radiated electromagnetic wave from the antenna units. The medium substrate is insulated and made of any of a ceramic material, a polymer material, a ferroelectric material, a ferrite material and a ferromagnetic material. Each of the antenna units further includes a grounding unit, and the antenna units are attached on a surface of the medium substrate in an array form. The feeder line is fed in through capacitive coupling or inductive coupling.

Preferably, the groove topology pattern is an axially symmetric pattern.

Preferably, the groove topology pattern is a complementary split ring resonator pattern, or a split spiral ring pattern, or an axially symmetric composite pattern that is obtained through derivation from one of, combination of or arraying of one of the complementary split ring resonator pattern and the split spiral ring pattern.

Preferably, the groove topology pattern is an axially asymmetric pattern.

Preferably, the groove topology pattern is a complementary spiral line pattern, or a complementary meander line pattern, or an axially asymmetric pattern that is obtained through derivation from one of combination of or arraying of one of the complementary spiral line pattern and the complementary meander line pattern.

Preferably, the polymer material is polytetratluoroethylene (PTFE), F4B or FR4.

To achieve the aforesaid objective, the present disclosure further provides an antenna device, which includes an array antenna and a power divider. The array antenna includes a plurality of antenna units, and each of the antenna units includes a conductive sheet engraved with a groove topology pattern, conductive feeding points and a feeder line. The power divider is adapted to divide a baseband signal into a plurality of weighted signals and then transmit the weighted signals to the antenna units arranged in an array via the conductive feeding points respectively.

Preferably, the array antenna further includes an insulatdd medium substrate, each of the antenna units further includes a grounding unit, and the antenna units are attached on a surface of the medium substrate in an array form.

Preferably, the medium substrate is made of any of a ceramic material, a polymer material, a ferroelectric material, a ferrite material and a ferromagnetic material.

Preferably, the polymer material is polytetrafluoroethylene (PTFE), F4B or FR4.

Preferably, the groove topology pattern is an axially symmetric pattern.

Preferably, the groove topology pattern is a complementary split ring resonator pattern, or a split spiral ring pattern, or an axially symmetric composite pattern that is obtained through derivation from one of, combination of or arraying of one of the complementary split ring resonator pattern and the split spiral ring pattern.

Preferably, the groove topology pattern is an axially asymmetric pattern.

Preferably, the groove topology pattern is a complementary spiral line pattern, or a complementary meander line pattern, or an axially asymmetric pattern that is obtained through derivation From one of combination of or arraying of one of the complementary spiral line pattern and the complementary meander line pattern.

Preferably, the antenna device further includes a reflecting unit, which is adapted to reflect a backward radiated electromagnetic wave from the antenna units.

By arraying the antenna units and using the beam forming method, the directionality of the antenna can be designed as needed through phase superposition between the antenna units; and then, a reflective metal plate is provided on the back side of the antenna so that a back lobe of the antenna is compressed. In this way, the miniaturized antenna array can obtain a high directionality so as to replace most of the conventional indoor antennae of a high directionality.

The present disclosure can be applied to the following wireless apparatus environments through use of corresponding wireless interfaces:

1) Wireless local area networks (802.11a/b/g/n/y). The present disclosure can he applied to apparatuses including wireless routers, and indoor mobile terminal wireless receivers such as computers, personal digital assistants (PDAs), wireless accessing points (AP) and the like.

2) Cellular network communication. The present disclosure can be applied to apparatuses including personal digital cellular (PDC) systems, Global Systems for Mobile Communications (GSM) [at various frequencies such as 400 MHz, 450 MHz, 850 MHz, 900 MHz, 1800 MHz and 1900 MHz], IS-95 (Code Division Multiple Access, CDMA), IS-2000 (CDMA2000), Generalized Packet Relay Service (GPRS), Wide Code Division Multiple Access (WCDMA), Time Division-Synchronous Code Division Multiple Access (TD-SCDMA), Universal Mobile Telecommunications Systems (UMTSs), High Speed OFDM Packet Access (HSUPA), High-Speed Uplink Packet Access (HSUPA), High-Speed Downlink Packet Access (HSUPA), Worldwide Interoperability for Microwave Access (WiMax), UMTS Long Term Evolution (LTE) and MIMO. That is, the present disclosure can be widely applied to various cellular network communication terminals including the $2^{nd}$, the $3^{rd}$ and the $4^{th}$ generation wireless terminals. The present disclosure can not only be applied to various mobile receiving terminals in the cellular network communication, but also be applied to transmitting terminals such as base station antennae for the $2^{nd}$, the $3^{rd}$ and the $4^{th}$ generation wireless communication systems.

3) Terminal antennae for Global Positioning Systems (GPSs).

4) Ultra-wideband (UWB) (within 13 m). The present disclosure can be applied to apparatuses including all wireless electronic apparatuses using the UWB technologies.

5) Bluetooth wireless apparatuses (IEEE802.15.1). The present disclosure can be applied to apparatuses including all wireless electronic apparatuses defined in the IEEE802.15.1 protocol.

6) Wireless communication apparatuses defined in the ZigBee (IEEE802.15.4) protocol such as industry monitors, sensor networks, home networks, security systems, on-board electronic systems and servo actuators. The wireless communication apparatuses defined in the IEEE802.15.4 protocol are all power-limited apparatuses, so low power consumption is required. The miniaturized antenna of the present disclosure can not only reduce the size of the hardware significantly but also decrease the power consumption of the hardware, so the miniaturized antenna disclosed herein is much suitable for use in any wireless electronic apparatuses defined in the IEEE802.15.4 protocol.

7) Mobile networks not supported by wired infrastructures such as sensor networks, body sensor networks and Ad Hoc networks. Such networks have a high requirement on the size of the wireless terminals and it is desirable to reduce the size of the wireless terminals as much as possible, so the miniaturized antenna designed in the present disclosure can effectively solve the technical bottleneck for such wireless networks.

8) Medical electronic wireless apparatuses (IEEE 1073) including medical ventilation installations, electric shock generators, patient monitoring apparatuses in acute disease hospitals, home care apparatuses, medical imaging apparatuses such as magnetic resonance imaging (MRI), and so on. The total frequency spectrum used in the IEEE 1073 is 14 MHz, which is reserved specially for the medical wireless applications by Federal Communications Commission (FCC) in October 2002. FCC has planed to extract the frequency spectrum from wavebands of 608-614 MHz, 1395-1400 MHz and 1427-1432 MHz so as to provide a frequency spectrum free of interference for medical apparatuses. The miniaturized antenna proposed in this patent is completely suitable for use within the three wavebands. Therefore, the miniaturized antenna proposed in this patent can be widely applied to all medical electronic wireless apparatuses included in the IEEE 1073 standard.

9) Various transceiving devices for satellite communication. An array antenna system based on the RF chip miniaturized antenna of the present disclosure can be used for satellite antennae requiring a high gain.

10) Various radars and microwave detecting systems such as on-board radars, weather radars and maritime radars. The chip miniaturized antenna can be used as a radiating unit in the radar systems.

11) Chip antennae and read-write antennae for RF identification (RFID).

12) Various wireless entertainment & consumer electronic apparatuses, for example, miniaturized electronic apparatuses such as wireless HiFi earphones (2.4 GHz-2.48 GHz and 433 MHz-434 MHz), wireless mobile hard disk drives, printers, wireless gamepads, wireless mice (27.085 MHz and 27.135 MHz) and keyboards (27.185 MHz and 27.035 MHz), and all electronic apparatuses using a Bluetooth antenna.

13) The multi-mode RF design involving the aforesaid wireless technologies.

DETAILED DESCRIPTION OF THE INVENTION

Metamaterial antennae are designed on the basis of the man-made electromagnetic material theories. The man-made electromagnetic material refers to an equivalent special electromagnetic material produced by enchasing a metal sheet into a topology metal structure of a particular form and disposing the topology metal structure of the particular form on a substrate having a certain dielectric constant and a certain magnetic permeability. Performance parameters of the man-made electromagnetic material are mainly determined by the subwavelength topology metal structure of the particular form. In the resonance waveband, the man-made electromagnetic material usually exhibits a highly dispersive characteristic; i.e., the impedance, the capacitance and the inductance, the equivalent dielectric constant and the magnetic permeability of the antenna vary greatly with the frequency. Therefore, the basic characteristics of the antenna can be altered according to the man-made electromagnetic material technologies so that the metal structure and the medium substrate attached thereto equivalently form a special electromagnetic material that is highly dispersive, thus achieving a novel antenna with rich radiation characteristics.

According to the aforesaid principle, the present disclosure designs a multi-mode antenna device. Specifically, a conductive sheet is attached on a medium substrate, and then the conductive sheet is engraved to remove a part thereof so that the conductive sheet is formed into a particular form. Because of the highly dispersive characteristic of the conductive sheet in the particular form, the antenna has rich radiating characteristics.

Thus, the design of the impedance matching network is omitted to achieve miniaturization and multi-mode operation of the antenna.

Figure 1:
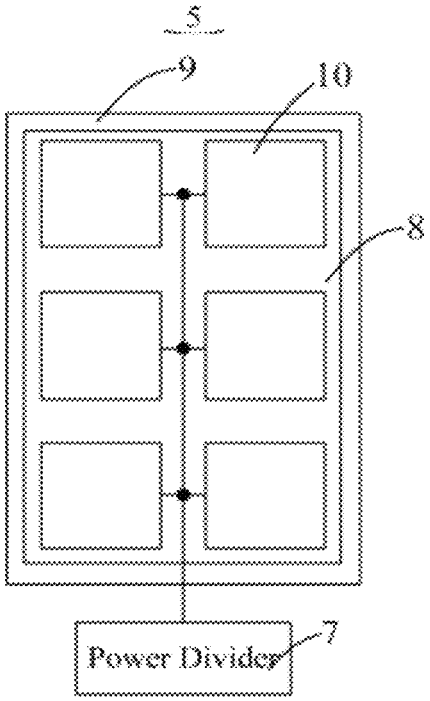
FIG. 1 is a schematic plan view of an antenna device according to an embodiment of the present disclosure.

Referring to FIG. 1, there is shown a schematic plan view of an antenna device according to an embodiment of the present disclosure. The antenna device 5 includes an array antenna 8, a reflecting unit 9 disposed at a side of the array antenna 8, and a power divider 7. The array antenna 8 includes a plurality of antenna units 10. When the antenna device 5 transmits an electromagnetic wave, the reflecting unit 9 is adapted to reflect a backward radiated electromagnetic wave from the antenna units 10 so that a back lobe of the antenna device 5 is compressed to increase the transmission efficiency of the antenna device.

The power divider 7 is adapted to divide a baseband signal into a plurality of weighted signals and then assign the weighted signals to the individual antenna units 10 arranged in an array respectively so that an electromagnetic wave directional radiating range is generated for the array antenna 8 according to the beam forming technologies. In this embodiment, the power divider 7 is a six-power divider.

Figure 2:
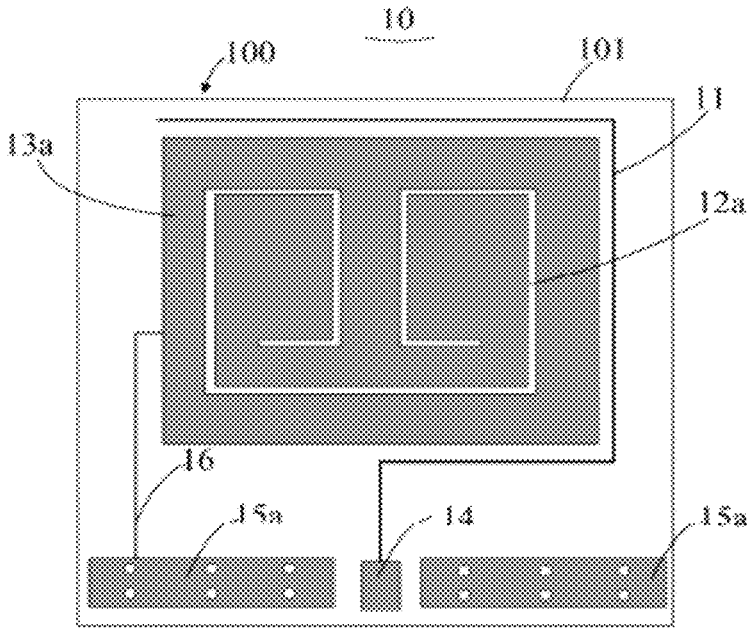
FIG. 2 is a schematic plan view of an antenna unit in the antenna device shown in FIG. 1.

FIG. 2 is a schematic plan view of an antenna unit in the antenna device shown in FIG. 1. The antenna unit 10 includes an insulative medium substrate 100, a conductive sheet 13*a* is attached on a surface 101 of the medium substrate 100, and the conductive sheet 13*a* is engraved with a groove topology pattern 12*a*. In this embodiment, a copper sheet is used as the conductive sheet 13*a*, and an axially symmetric pattern 12*a* is engraved on the copper sheet. In other embodiments, the groove topology pattern 12*a* is an axially asymmetric pattern.

A conductive feeding point 14, a feeder line 11 electrically connected to the conductive feeding point 14, a grounding unit 15*a* and a grounding line 16 are further formed on the first surface 101. In this embodiment, the conductive sheet 13*a* is connected to the grounding unit 15*a* via the grounding line 16. The feeder line 11 is linked with the conductive sheet 13*a* through electromagnetic coupling. In other embodiments, the feeder line 11 and the grounding line 16 may be generally viewed as two pins of the antenna and are fed in via a stand impedance of 50 ohm respectively.

However, the feeder line 11 may be fed in through capacitive coupling or inductive coupling and the grounding line 16 may be grounded also through capacitive coupling or inductive coupling. Specifically, there may be four options for the combination of the feeding-in manner of the feeder line 11 and the grounding manner of the grounding line 16: the feeder line is fed in through inductive coupling while the grounding line is grounded through inductive coupling; the feeder line is fed in through inductive coupling while the grounding line is grounded through capacitive coupling; the feeder line is fed in through capacitive coupling while the grounding line is grounded through inductive coupling; and the feeder line is fed in through capacitive coupling while the grounding line is grounded through capacitive coupling. For the antenna units 10 on the array antenna 8, the topology microstructures and sizes thereof may all be the same, or may be different from each other so that a mixed design is provided.

By adjusting the feeding-in manner of the feeder line 11, the grounding manner of the grounding line 16, the topology microstructure and the size of each of the antenna units 10, and positions of short-circuit points between the feeder line II and the grounding line 16 and the antenna units 10, the antenna device 5 of the present disclosure can be adjusted accomplish multi-mode operation.

Figure 3:
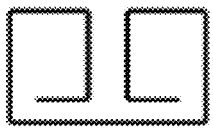
FIG. 3 is a schematic view of a conductive sheet formed with a complementary split ring resonator pattern.
Figure 4:
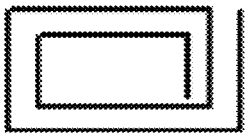
FIG. 4 illustrates the conductive sheet formed with a complementary spiral line pattern.
Figure 5:
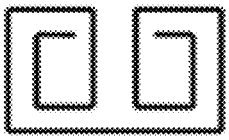
FIG. 5 illustrates the conductive sheet formed with a split spiral ring pattern.
Figure 6:
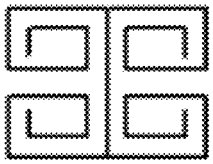
FIG. 6 illustrates the conductive sheet formed with a dual split spiral ring pattern.
Figure 7:
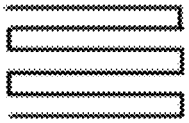
FIG. 7 illustrates the conductive sheet formed with a complementary meander line pattern.
Figure 8:
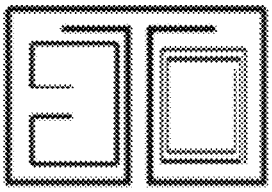
FIG. 8 illustrates the conductive sheet formed with an axially asymmetric composite pattern.
Figure 9:
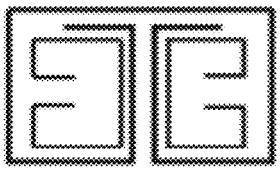
FIG. 9 illustrates the conductive sheet formed with an axially symmetric composite pattern.

Referring to FIG. 3 to FIG. 9, FIG. 3 illustrates the conductive sheet formed with a complementary split ring resonator pattern; FIG. 4 illustrates the conductive sheet formed with a complementary spiral line pattern; FIG. 5 illustrates the conductive sheet formed with a split spiral ring pattern; FIG. 6 illustrates the conductive sheet formed with a dual split spiral ring pattern; FIG. 7 illustrates the conductive sheet formed with a complementary meander line pattern; FIG. 8 illustrates the conductive sheet formed with an axially asymmetric composite pattern; and FIG. 9 illustrates the conductive sheet formed with an axially symmetric composite pattern.

In case of an axially symmetric pattern, the groove topology pattern 12*a* may be the complementary split ring resonator pattern shown in FIG. 3, the split spiral ring pattern shown in FIG. 5, the dual split spiral ring pattern shown in FIG. 6 and the axially symmetric composite pattern shown in FIG. 9. In case of an axially asymmetric pattern, the groove topology pattern 12*a* may be but not limited to the complementary spiral line pattern shown in FIG. 4, the complementary meander line pattern shown in FIG. 7 and the axially asymmetric composite pattern shown in FIG. 8.

Figure 10:
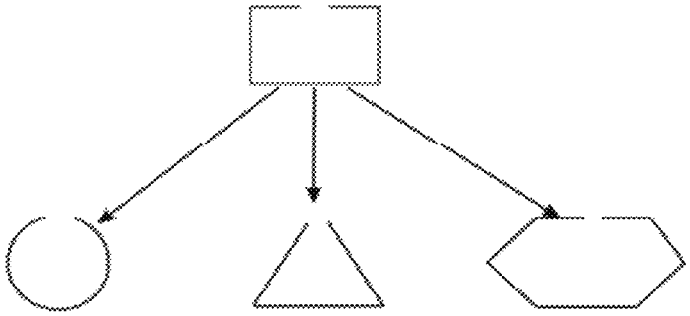
FIG. 10 illustrates patterns obtained through geometry derivation from a topology structure formed on the conductive sheet.
Figure 11:
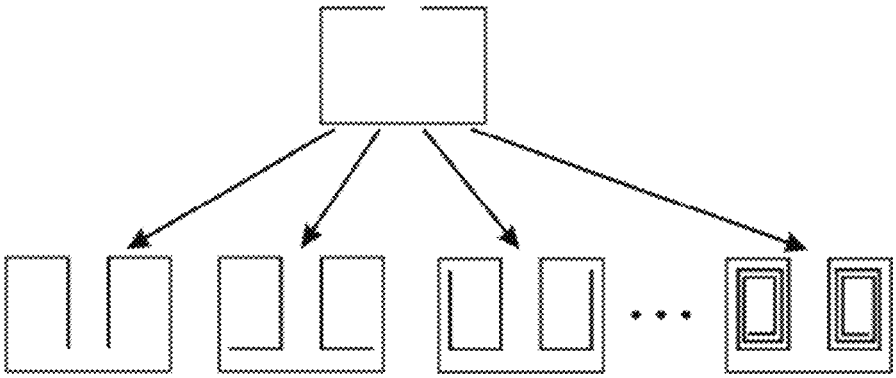
FIG. 11 illustrates patterns obtained through extension derivation from the topology structure formed on the conductive sheet.

The groove topology pattern 12*a* may further be formed into more derivative patterns through derivations as shown in FIG. 10 and FIG. 11. FIG. 10 is a schematic view illustrating geometry derivations; and the geometry derivation means that the form of the conductive sheet 13*a* in the present disclosure is not merely limited to a rectangular form, but may also be any 2D geometries such as a circular form, a triangular form and a polygonal form. FIG. 11 is a schematic view illustrating extension derivations; and the expansion derivation means that without changing the intrinsic properties the original conductive sheet 13*a*, any part of the conductive sheet may be removed through engraving to derive a symmetric or asymmetric pattern.

As can be known from the principle of the antenna, the electric length is a physical parameter describing a frequency at which the waveform of the electromagnetic wave varies, and the electric length=the physical length/the wavelength. When the antenna operates at a low frequency which corresponds to a long wavelength of the electromagnetic wave, the physical length must be increased if it is desired to keep the electric length unchanged. However, increasing the physical length will necessarily fail to satisfy the requirement for miniaturization of the antenna. As can be known from the formula $f=1/(2\pi\sqrt{LC})$, increasing the distributed capacitance can effectively reduce the operating frequency of the antenna so that the electric length can be kept unchanged without increasing the physical length. In this way, an antenna operating at an extremely low frequency can be designed within a very small space.

The medium substrate 100 of the present disclosure may be made of any of a ceramic material, a polymer material, a ferroelectric material, a ferrite material and a ferromagnetic material. The polymer material is preferably polytetratluoroethylene (PTFE), F4B or FR4. In the present disclosure, the antenna may be manufactured in various ways so long as the design principle of the present disclosure is followed. The most common method is to adopt manufacturing methods of various printed circuit boards (PCBs), and both the manufacturing method of a PCB formed with metallized through-holes and that of a PCB covered by copper on both surfaces thereof can satisfy the processing requirement of the present disclosure. Apart from this, other processing means may also be used depending on actual requirements, for example, the conductive silver paste & ink processing for the radio frequency identification (RFID), the flexible PCB processing for various deformable components, the ferrite sheet antenna processing, and the processing means of the ferrite sheet in combination with the PCB. The processing means of the ferrite sheet in combination with the PCB means that the chip microstructure portion is processed by an accurate processing process for the PCB and other auxiliary portions are processed by using ferrite sheets.

The embodiments of the present disclosure have been described above with reference to the attached drawings; however, the present disclosure is not limited to the aforesaid embodiments, and these embodiments are only illustrative but are not intended to limit the present disclosure. Those of ordinary skill in the art may further devise many other implementations according to the teachings of the present disclosure without departing from the spirits and the scope claimed in the claims of the present disclosure, and all of the implementations shall fall within the scope of the present disclosure.

What is claimed is:

1. An antenna device, comprising:

an array antenna comprising a plurality of antenna units, each of the antenna units comprising a conductive sheet engraved with a groove topology pattern, a conductive feeding point and a feeder line; and a power divider, being adapted to divide a baseband signal into a plurality of weighted signals and then transmit the weighted signals to the antenna units arranged in an array via the conductive feeding points respectively;

wherein the antenna device further comprises a reflecting unit, and the reflecting unit is adapted to reflect a backward radiated electromagnetic wave from the antenna units;

wherein each of the antenna units further comprises an insulative medium substrate, a grounding unit and a grounding line, the conductive sheet is attached on a surface of the medium substrate, the conductive sheet is engraved with the groove topology pattern;

the conductive feeding point, the feeder line electrically connected to the conductive feeding point, the grounding unit and the grounding line are further formed on the surface of the medium substrate, and the conductive sheet is connected to the grounding unit via the grounding line.

2. The antenna device of claim 1, wherein the array antenna further comprises an insulated medium substrate, each of the antenna units further comprises a grounding unit, and the antenna units are attached on a surface of the medium substrate in an array form.

3. The antenna device of claim 2, wherein the medium substrate is made of any of a ceramic material, a polymer material, a ferroelectric material, a ferrite material and a ferromagnetic material.

4. The antenna device of claim 3, wherein the polymer material is polytetrafluoroethylene (PTFE), F4B or FR4.

5. The antenna device of claim 2, wherein the groove topology pattern is an axially symmetric pattern.

6. The antenna device of claim 5, wherein the groove topology pattern is a complementary split ring resonator pattern, or a split spiral ring pattern, or an axially symmetric composite pattern that is obtained through derivation from one of, combination of or arraying of one of the complementary split ring resonator pattern and the split spiral ring pattern.

7. The antenna device of claim 2, wherein the groove topology pattern is an axially asymmetric pattern.

8. The antenna device of claim 7, wherein the groove topology pattern is a complementary spiral line pattern, or a complementary meander line pattern, or an axially asymmetric pattern that is obtained through derivation from one of, combination of or arraying of one of the complementary spiral line pattern and the complementary meander line pattern.

9. The antenna device of claim 2, wherein the grounding unit, the conductive sheet, the conductive feeding point and the feeder line of each of the antenna units are the same surface of the medium substrate.

10. The antenna device of claim 1, wherein the reflecting unit is a plate arranged behind the plurality of antenna units to reflect a backward radiated electromagnetic wave from the antenna units.

* * * * *